US006308936B1

(12) United States Patent
Atwood

(10) Patent No.: US 6,308,936 B1
(45) Date of Patent: Oct. 30, 2001

(54) GUARDRAIL BLOCK

(76) Inventor: William D. Atwood, Rt. 2, Box 292, Kosciusko, MS (US) 39090

( * ) Notice: Subject to any disclaimer, the term of this patent is extended or adjusted under 35 U.S.C. 154(b) by 0 days.

(21) Appl. No.: 09/265,361

(22) Filed: Mar. 10, 1999

(51) Int. Cl.[7] ..... A01K 3/00

(52) U.S. Cl. ..... 256/13.1; 256/1; 256/59; 256/19; 404/6; 404/7

(58) Field of Search ..... 256/13.1, 59, 19, 256/1, 65; 404/6, 7

(56) References Cited

U.S. PATENT DOCUMENTS

| | | | | |
|---|---|---|---|---|
| 3,506,243 | * | 4/1970 | Seiler | 256/59 |
| 3,776,520 | | 12/1973 | Charles et al. . | |
| 4,104,000 | * | 8/1978 | Fleischmann | 256/59 |
| 4,289,419 | * | 9/1981 | Young et al. . | |
| 4,473,607 | * | 9/1984 | Mannella . | |
| 4,809,955 | * | 3/1989 | Veileux | 256/59 |
| 5,123,221 | * | 6/1992 | Lagault | 52/293 |
| 5,451,118 | * | 9/1995 | Wilkins et al. | 404/6 |
| 5,507,473 | | 4/1996 | Hammer et al. . | |
| 5,657,967 | | 8/1997 | Patreick . | |
| 5,660,375 | * | 8/1997 | Freeman | 256/19 |
| 6,007,269 | * | 12/1999 | Marinelli | 406/6 |

FOREIGN PATENT DOCUMENTS

| | | | | |
|---|---|---|---|---|
| 1658664 | * | 12/1970 | (DE) . | |
| 3334927 | * | 3/1984 | (DE) . | |
| 0215994 | * | 4/1987 | (EP) . | |
| 2 478698 | * | 3/1980 | (FR) | 256/13.1 |
| 6803272 | * | 9/1968 | (NL) . | |

* cited by examiner

*Primary Examiner*—Lynne H. Browne
*Assistant Examiner*—Tomlyne A Malcolm
(74) *Attorney, Agent, or Firm*—David A. Tamburro

(57) ABSTRACT

A guardrail post block made from recycled plastic waste material. The block is of generally rectangular construction whose side faces have large radiused channels formed therealong and large transverse voids extending through the center of the block between the channels. The channels and voids substantially reduce the weight of the block while maintaining required strength.

8 Claims, 1 Drawing Sheet

GUARDRAIL BLOCK

BACKGROUND OF THE INVENTION

This invention relates generally to guardrail systems which extend along roadways and, more particularly, to a novel guardrail block which is incorporated into such systems.

Standard guardrail systems generally include a plurality of vertical rectangular wooden posts longitudinally spaced and fixed in place along the shoulder of a roadway, a longitudinally extending metal W-beam guardrail, a rectangular wooden post or spacer block mounted between each post and the guardrail, and bolt assemblies connecting the blocks and guardrail to the posts.

Often the wood blocks are about 6"×8"×14" and have a rectangular recess cut into their back face to fit around the posts. The wood blocks weigh about 18 pounds each and can be heavy and awkward for the installer to handle. In addition the blocks utilize natural resources, trees, and require a cutting operation for the recess on the back face, thus increasing cost.

SUMMARY OF THE INVENTION

Accordingly, the primary object of the invention is to provide a novel post block constructed of recycled plastic material and configured in a way which substantially reduces the weight of the block while still maintaining required strength.

Another object of the invention is to provide the above novel post block which is of generally rectangular configuration but has weight reducing recesses on the sides of the block and, in some instances, weight reducing voids extending transversely through the block.

Still another object of the invention is to provide the above novel post block also containing a rectangular recess on its back face, with the side recesses, the voids, and back recess being formed in the block during a plastic molding process.

The novel block of the invention is molded from recycled post-consumer or post-industrial waste plastic, e.g. polypropylene, high density ethylene, low density ethylene, or combinations thereof, and thus not only protects the environment, but also reduces cost. The block could also possibly contain up to 20% fly ash.

Other characteristics and advantages of the invention will become apparent from the following description of the invention wherein reference is made to the accompanying drawings.

DETAILED DESCRIPTION OF THE INVENTION

Figure 1:
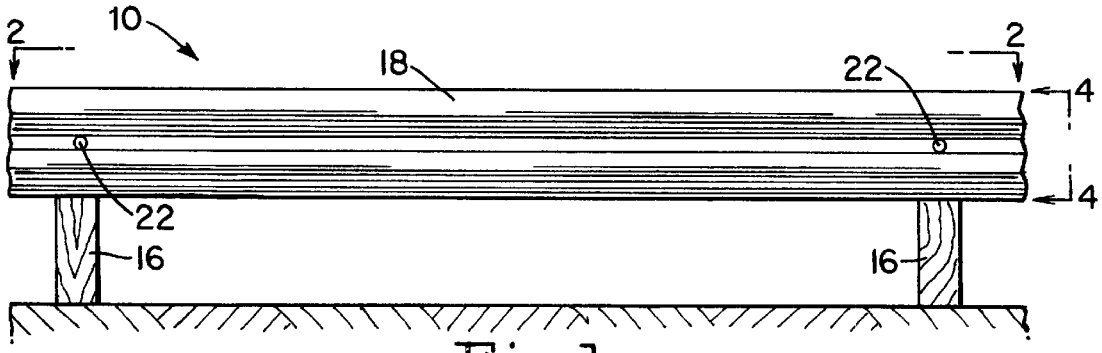
FIG. 1 is a fragmentary front elevational view of a guardrail system incorporating the novel post block of the invention.
Figure 2:
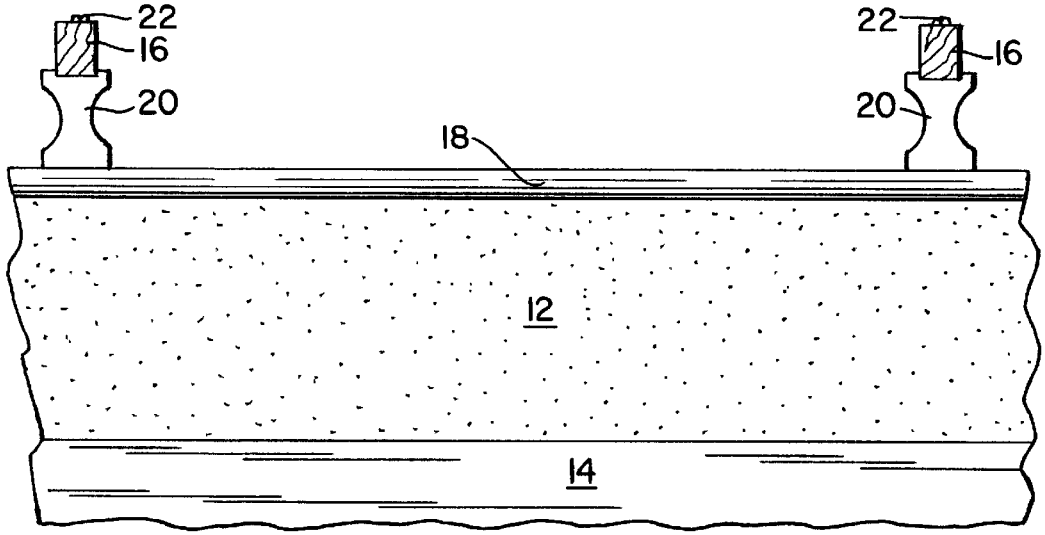
FIG. 2 is a fragmentary plan view taken along line 2—2 of FIG. 1.

FIGS. 1 and 2 illustrate the usual guardrail system 10 located along the shoulder 12 of roadway 14 and including a plurality of vertical rectangular posts 16 longitudinally spaced and embedded along shoulder 12, a longitudinally extending metal W-beam guardrail 18, the novel post block 20 mounted between each post 16 and guardrail 18, and a bolt assembly 22 fastening guardrail 18 and block 20 to each post 16.

Figure 3:
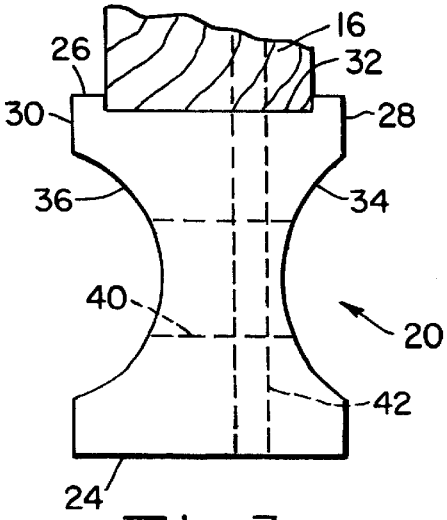
FIG. 3 is an enlarged top plan view of the post block of the invention.
Figure 4:
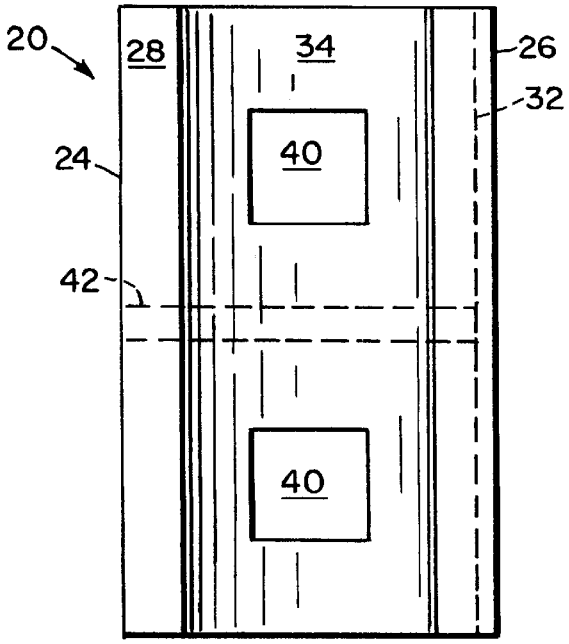
FIG. 4 is an enlarged side elevation view of the post block of the invention taken along line 4—4 of FIG. 1.

As shown in FIGS. 3 and 4 post block 20 is of generally rectangular construction (6"×8"×14") having a vertically extending front face 24 against which guardrail 18 abuts, rear face 26, and side faces 28, 30. A vertical recess 32 is centrally formed in rear face 26, and the front face of post 16 fits within the recess.

To reduce the overall weight of block 20 and facilitate its handling and installation by a worker, large radiused cavities or channels 34 and 36 are formed along the full height of sides 28 and 30, respectively. The channels are of substantial size, e.g., the width of the opening of the channels at their points of intersection with the straight portions of the sides 28 and 30 is about two-thirds of the total depth, front to back, of the sides. Similarly, the combined total depth of channels 34 and 36 is somewhat more than half the width of the block. The large radius of channels 34 and 36 facilitates molding, reduces weight, eliminates any sharp stress areas within the channels, but yet maintains required strength.

To further reduce the weight of block 20 and facilitate its handling, one or more equally distributed voids or openings 40 of substantial size (about 2½" square or round) extend transversely through the center section of the block between channels 34 and 36.

A hole 42 extends from front face 24 to recess 32 to receive the bolt assembly 22.

As mentioned above, block 20 is advantageously constructed from recycled plastic waste material, thus reducing the waste dumped into the environment. Recess 32, channels 34 and 36, voids 40, and hole 42 are integrally molded in the block during the molding process and channels 34 and 36 and voids 40 are made as large as possible without sacrificing strength requirements of the block.

The novel plastic block 20 weights at least 30% less than the standard rectangular wooden block described initially hereinabove, and it is easier to carry and handle due to the presence of channels 34, 36 and voids 40.

The foregoing relates to preferred exemplary embodiments of the invention, it being understood that other variants and embodiments thereof are possible within the spirit and scope of the invention, the latter being defined by the appended claims.

What is claimed is:

1. A guardrail block molded from plastic material and being of generally rectangular configuration, the block having elongated front, rear, and first and second side faces, each of said side faces having a channel formed therealong to reduce the weight of the block, said channels being formed on a radius and extending along the full height of said side faces, weight reducing void means extending transversely through the block between said channels in said side faces, and a bolt receiving opening extending through the block from said front face to said rear face.

2. The guardrail block of claim 1, wherein said channels are of a substantial size with respect to the overall size of the block.

3. A guardrail block molded from plastic material and being of generally rectangular configuration, the block having elongated front, rear, and first and second side faces, each of said side faces having a channel formed therealong to reduce the weight of the block, said channels being formed on a radius and extending along the full height of said side faces, and a bolt receiving opening extending through the block from said front face to said rear face.

4. A guardrail block molded from plastic material and being of generally rectangular configuration, the block having elongated front, rear, and first and second side faces, each of said side faces having a channel formed therealong to reduce the weight of the block, said channels being formed on a radius and extending along the full height of said side faces, said channels being of a substantial size with respect to the overall size of the block, and a bolt receiving opening extending through the block from said front face to said rear face.

5. A plastic guardrail block of generally rectangular configuration and having elongated front, rear, and first and second side faces, each of said side faces having a radiused channel extending substantially along its entire height to reduce the weight of the block, a post receiving recess extending along the entire height of said rear face, and a bolt relieving opening extending through the block from said front face to said recess.

6. The guardrail block of claim 5, wherein said channels are of a substantial size with respect to the overall size of the block.

7. The guardrail block of claim 6, comprising weight reducing void means extending transversely through the block between said channels in said side faces.

8. The guardrail block of claim 5, comprising weight reducing void means extending transversely through the block between said channels in said side faces.

* * * * *